US006893355B2

(12) United States Patent
Souza et al.

(10) Patent No.: US 6,893,355 B2
(45) **Date of Patent: *May 17, 2005**

(54) GOLF PUTTER HEAD WITH INCREASED DIMENSIONS AND INCREASED MOMENT OF INERTIA

(75) Inventors: John C. Souza, Phoenix, AZ (US); Anthony D. Serrano, Peoria, AZ (US); John A. Solheim, Phoenix, AZ (US); David D. Jones, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/837,860

(22) Filed: May 3, 2004

(65) Prior Publication Data

US 2004/0254029 A1 Dec. 16, 2004

Related U.S. Application Data

(63) Continuation of application No. 10/462,899, filed on Jun. 16, 2003.

(51) Int. Cl.[7] ..... A63B 69/36; A63B 53/04; A63B 53/02

(52) U.S. Cl. ..... 473/251; 473/313; 473/340; 473/349

(58) Field of Search ..... 473/242–255, 473/324–350

(56) References Cited

U.S. PATENT DOCUMENTS '

| | | | | | |
|---|---|---|---|---|---|
| D58,209 | S | * | 6/1921 | Bacheller | D21/745 |
| D163,083 | S | * | 5/1951 | Belline | D21/745 |
| 2,954,231 | A | * | 9/1960 | MacIntyre | 473/251 |
| D218,178 | S | | 7/1970 | Solheim | |
| D230,869 | S | * | 3/1974 | Winter | D21/745 |
| D234,960 | S | | 4/1975 | Swash | |
| D235,668 | S | | 7/1975 | Swash | |
| D255,373 | S | | 6/1980 | Solheim | |
| 4,444,395 | A | * | 4/1984 | Reiss | 473/335 |
| D282,952 | S | * | 3/1986 | Mattingly | D21/746 |
| 4,815,739 | A | * | 3/1989 | Donica | 473/313 |
| 5,160,141 | A | * | 11/1992 | Crews | 473/313 |
| 5,213,332 | A | * | 5/1993 | Fahy et al. | 473/243 |
| D341,405 | S | | 11/1993 | Solheim | |
| 5,482,281 | A | | 1/1996 | Anderson | |
| D379,484 | S | | 5/1997 | Solheim | |
| 5,630,765 | A | * | 5/1997 | Moore | 473/252 |
| D380,029 | S | | 6/1997 | Anderson | |
| D399,911 | S | | 10/1998 | Nicolette | |
| 5,830,078 | A | * | 11/1998 | McMahan | 473/252 |
| D402,722 | S | * | 12/1998 | Rollinson | D21/742 |
| 5,842,935 | A | | 12/1998 | Nelson | |
| D405,137 | S | | 2/1999 | Nelson | |
| D410,717 | S | | 6/1999 | Anderson | |
| D411,271 | S | | 6/1999 | Nelson | |
| 6,059,669 | A | * | 5/2000 | Pearce | 473/339 |
| 6,080,070 | A | * | 6/2000 | Whitley | 473/340 |
| D449,865 | S | | 10/2001 | Fife, Jr. | |
| D451,973 | S | | 12/2001 | Wells | |
| 6,350,208 | B1 | * | 2/2002 | Ford | 473/249 |
| D460,990 | S | * | 7/2002 | Jung | D21/736 |

* cited by examiner

*Primary Examiner*—Sebastiano Passaniti
(74) *Attorney, Agent, or Firm*—Darrell F. Marquette

(57) ABSTRACT

A golf putter includes a putter head having a face member, a heel end, a toe end and a rear member extending in an arcuate path from one end of the face member to the other end of the face member. First and second struts extend and are connected to the rear member and the face member while converging toward each other as they approach the face member. A third strut extends between and is connected to the rear member and the face member and lies between the first and second struts. The putter head has a width W of at least 15 centimeters and a depth D that is at least equal to ½ width W. In its preferred embodiment, the putter head has a width W of approximately 17 centimeters and a depth D of approximately 10 centimeters.

12 Claims, 4 Drawing Sheets

GOLF PUTTER HEAD WITH INCREASED DIMENSIONS AND INCREASED MOMENT OF INERTIA

This application is a continuation-in-part of application Ser. No. 10/462,899 filed Jun. 16, 2003.

BACKGROUND OF THE INVENTION

This invention relates generally to golf equipment and, in particular, to a golf putter head with increased dimensions and increased moment of inertia.

Recent developments in golf equipment have resulted in golf putter heads with high moments of inertia. For example, U.S. Pat. No. 5,482,281 to D. W. Anderson discloses a putter head sold under the name DANSER. The Anderson putter head has heel and toe weights mounted on a lower plate-like member. The heel and toe weights and the lower plate-like member are preferably made of heavyweight material such as bronze or steel. An upper shell-like member, preferably made of lightweight material such as plastic or aluminum, is secured to the lower plate-like material to enclose the heel and toe weights. U.S. Pat. No. 5,842,935 to M. J. Nelson discloses a putter head sold under the name NELLI. The Nelson putter head has a horseshoe shaped body formed of high density material such as steel with thickened heel and toe portions. The horseshoe shaped body includes a cavity which receives an insert formed of low density material such as polyurethane. The insert preferably constitutes about 15% of the total weight of the putter head while constituting more than 50% of the total volume of the putter head.

SUMMARY OF THE INVENTION

The present invention provides a golf putter including a putter head having a face member, a heel end and a toe end. The face member has a front surface arranged for impacting a golf ball. The putter head also includes a rear member extending in an arcuate path from one end to the other end of the face member, and first and second struts extending between and connected to the rear member to the face member while converging toward each other as they approach the face member. A third strut may also be provided in the putter head extending from the rear member to the face member and lying between the first and second struts. The first, second and third struts may be aligned to define four substantially trapezoid shaped open spaces between the face member and the rear member. The putter head has a width W of at least 15 centimeters measured between its head and toe ends. The putter head also has a depth D that is at least equal to ½ width W measured between the front surface of the face member and an outer surface of the rear member.

DESCRIPTION OF THE INVENTION

Figure 1:
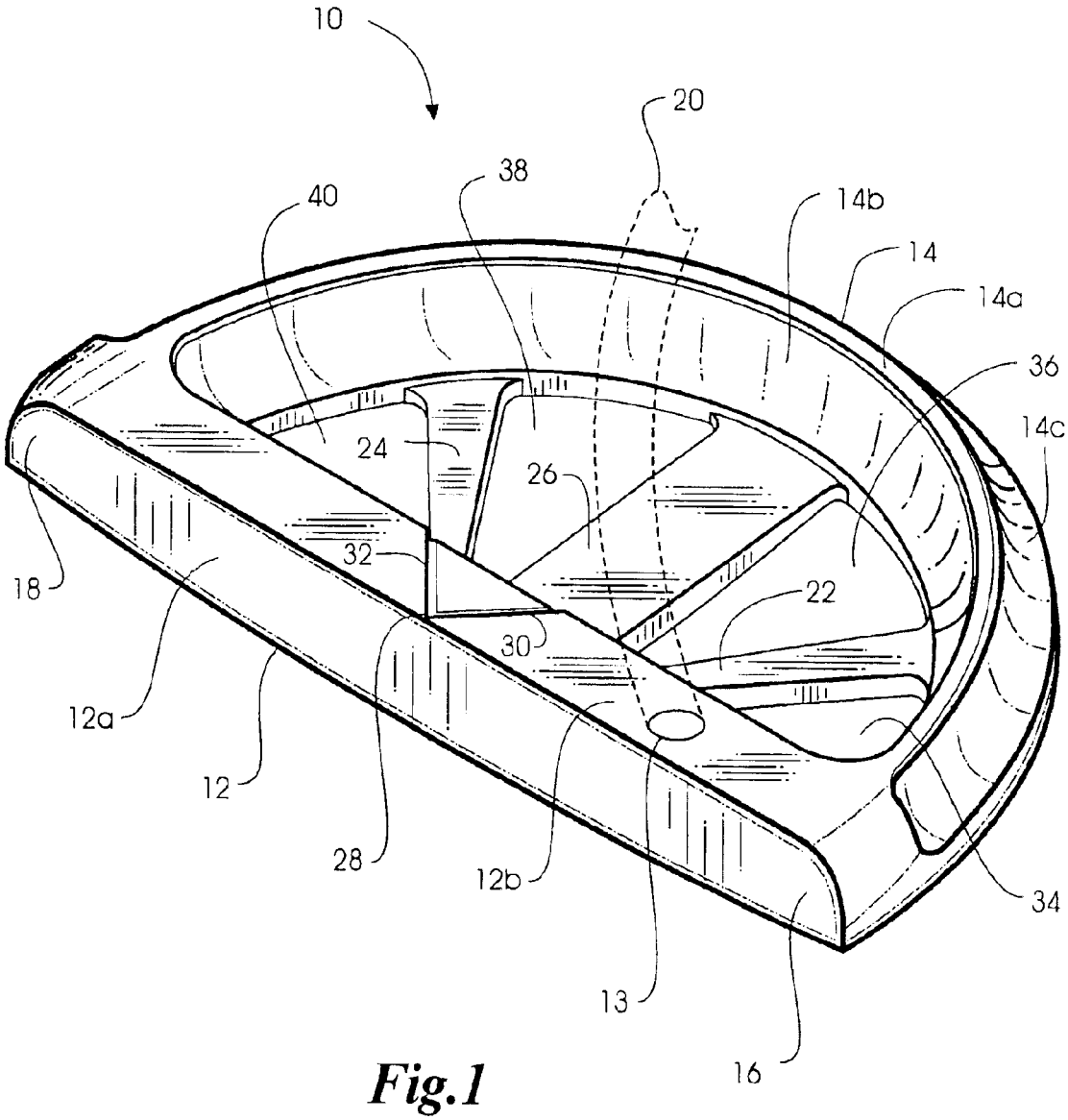
FIG. 1 is a perspective view of a golf putter head according to one embodiment of the present invention.
Figure 2:
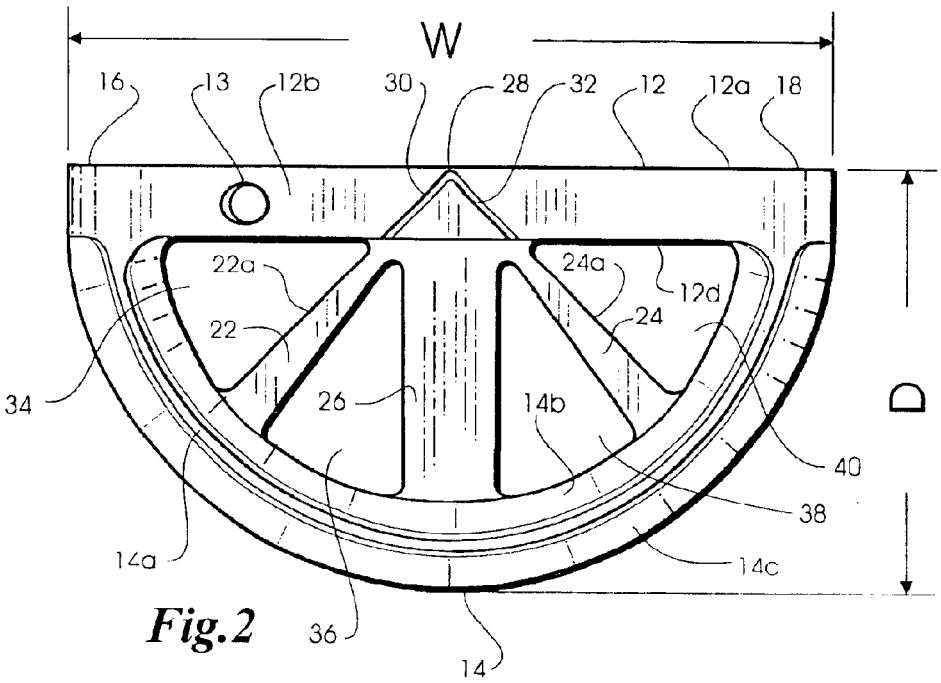
FIG. 2 is a top plan view of the golf putter head shown in FIG. 1.
Figure 3:
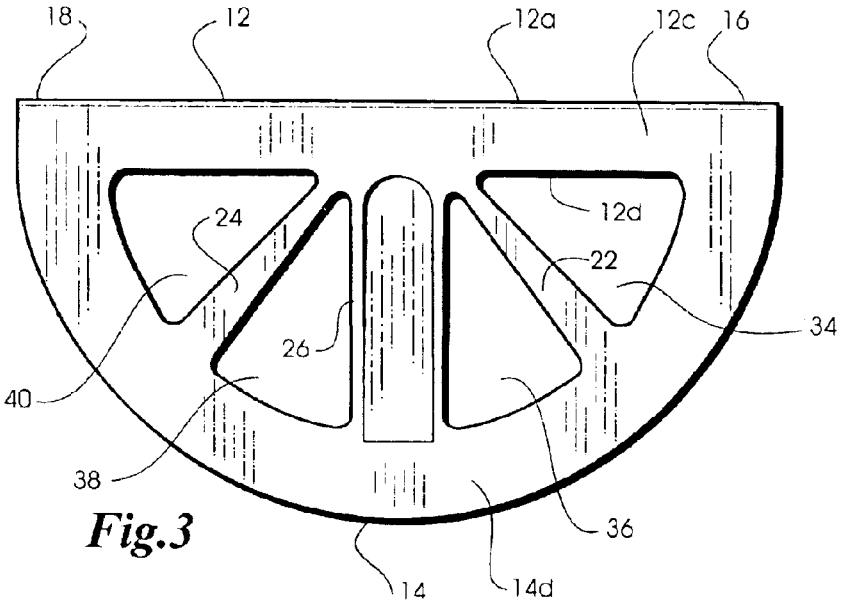
FIG. 3 is a bottom view of the golf putter head shown in FIG. 1.

Referring to FIG. 1, a golf putter head 10 includes a face member 12 and a rear member 14. The rear member 14 extends in an arcuate path of substantially 180 degrees from a heel end 16 of the face member 12 to a toe end 18 of the face member 12. The face member 12 has a front surface 12*a* arranged for impacting a golf ball, an upper surface 12*b* with a hole 13 formed therein for receiving a shaft 20, a lower surface 12*c* located opposite the upper surface 12*b*, and a back surface 12*d* located opposite the front surface 12*a*. The rear member 14 has an upper surface 14*a*, an inner surface 14*b*, an outer surface 14*c* and a lower surface 14*d*. The upper and lower surfaces 14*a*, 14*d* of the rear member 14 are located opposite each other, and the inner and outer surfaces 14*b*, 14*c* of the rear member 14 are located opposite each other.

The golf putter head 10 further includes a first strut 22, a second strut 24 and a third strut 26. The first and second struts 22, 24 extend from the rear member 14 to the face member 12 and converge toward each other as they approach the face member 12. A generally V-shaped marking 28 is provided on the upper surface 12*b* of the face member 12 between the heel and toe ends 16, 18. The V-shaped marking 28 has one leg 30 thereof aligned with an edge 22*a* of the first strut 22 and another leg 32 thereof aligned with an edge 24*a* of the second strut 24. The third strut 26 also extends from the rear member 14 to the face member 12 and lies between the first and second struts 22, 24.

It will be understood that the putter head 10 is preferably made of lightweight material such as aluminum or titanium so that it will have increased dimensions. For example, the putter head 10 may have a width W of between 4.0 and 12.0 inches, preferably 9.0 inches, measured between the heel end 12*a* and the toe end 12*b* of the face member 12. Also, the putter head 10 may have a depth D of between 2.0 and 6.0 inches, preferably 4.5 inches, measured between the front surface 12*a* of the face member 12 and the outer surface 14*a* of the rear member 14. These dimensions for the width W and depth D provide the putter head 10 with an increased moment of inertia.

The first, second and third struts 22, 24 and 26 are connected to the back surface 12*d* of the face member 12 and to the inner surface 14*b* of the rear member 14 and are arranged to define four triangularly shaped open spaces 34, 36, 38 and 40 between the face member 12 and the rear member 14. Open spaces 34 and 40 are of identical size while open spaces 36 and 38 are of identical size. The open spaces 34, 36, 38 and 40 allow the putter head 10 to have the increased dimensions described above without exceeding a desired weight of approximately 330 to 500 grams.

Figure 4:
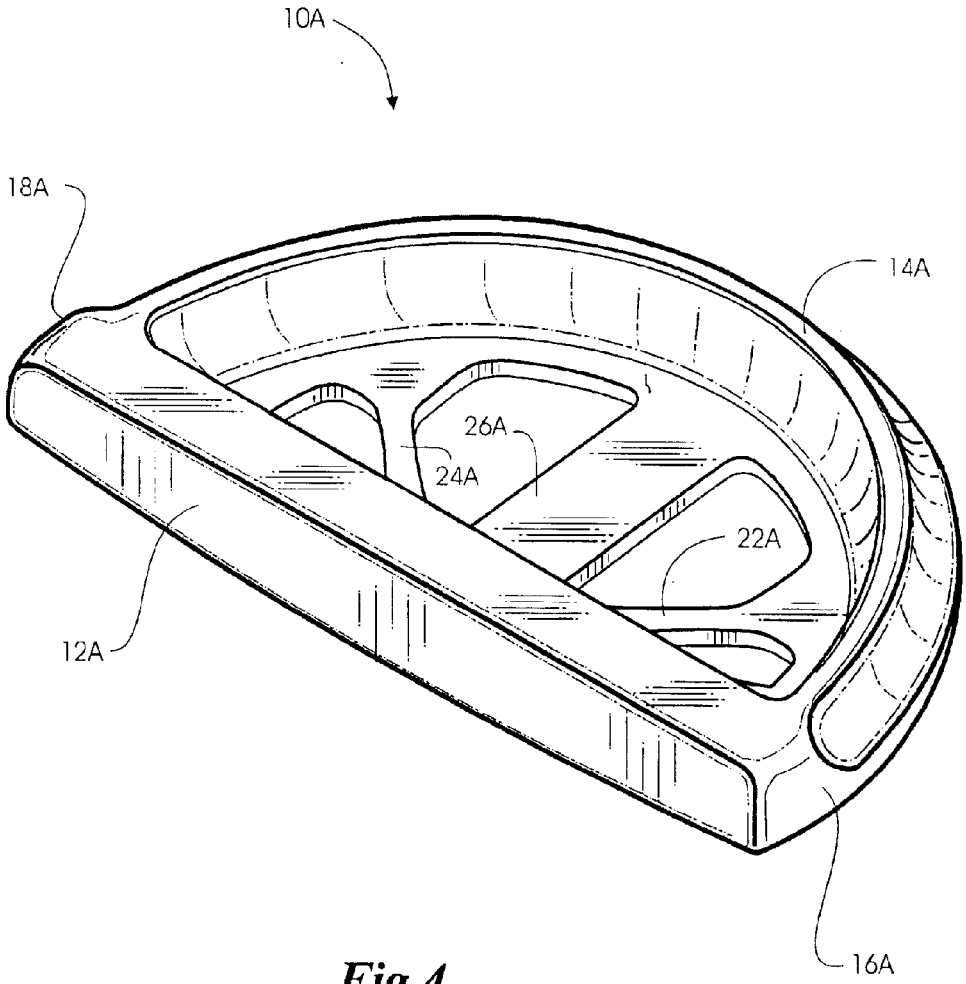
FIG. 4 is a perspective view of a golf putter head according to another embodiment of the present invention.
Figure 5:
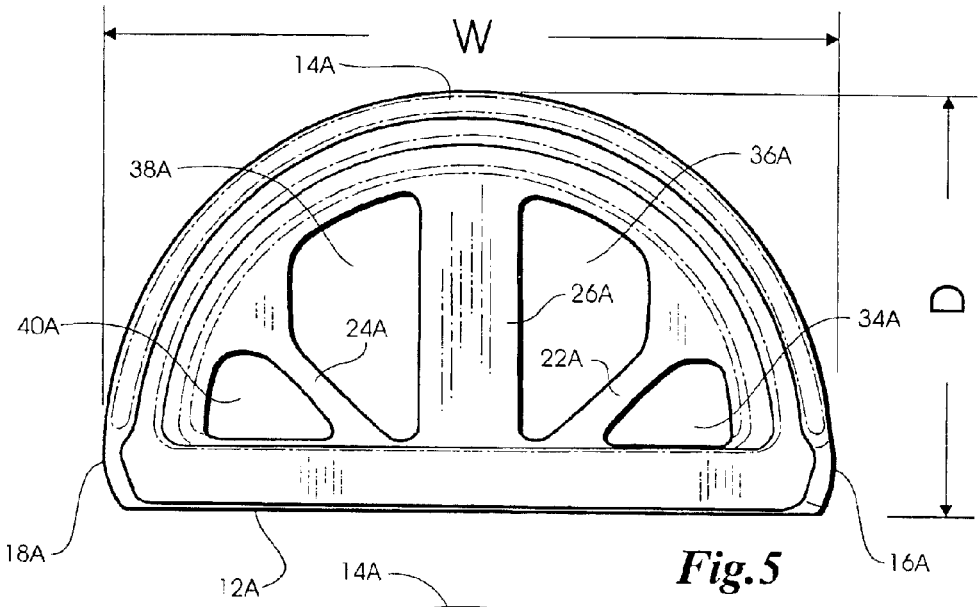
FIG. 5 is a top plan view of the golf putter head shown in FIG. 4.
Figure 6:
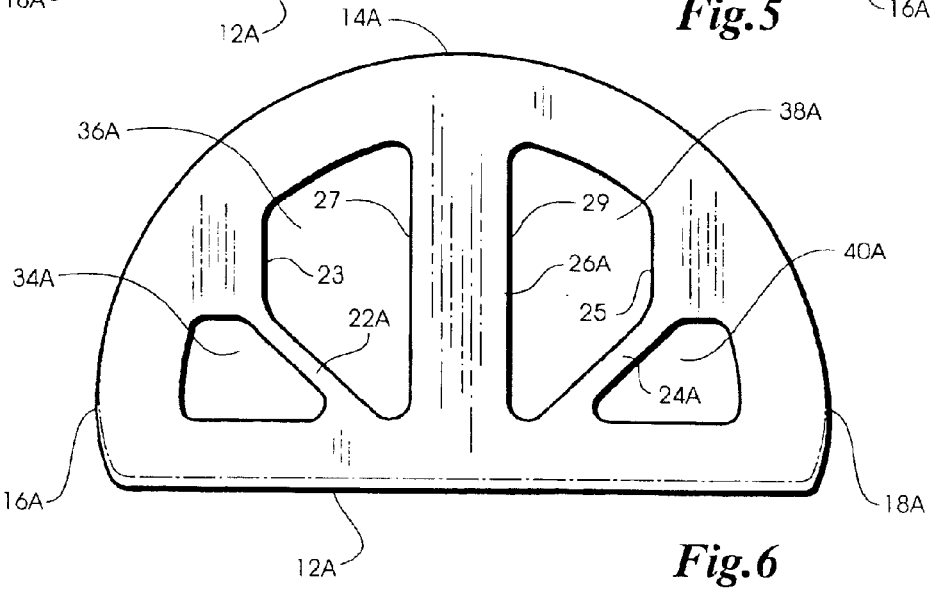
FIG. 6 is a bottom view of the golf putter head shown in FIG. 4.

Referring to FIGS. 4–6, a golf putter includes a putter head 10A similar to the putter head 10 shown in FIG. 1. Putter head 10A has a face member 12A, a rear member 14A, a heel end 16A and a toe end 18A. First, second and third struts 22A, 24A and 26A extend between and are connected to the face and rear members 12A, 14A. These struts 22A, 24A, 26A are arranged to define four substantially trapezoid shaped open spaces 34A, 36A, 38A and 40A between the face member 12A and the rear member 14A. The first strut 22A has an edge portion 23 arranged generally parallel to one edge 27 of the third strut 26A, and the second strut 24A has an edge portion 25 arranged generally parallel to the opposite edge 29 of the third strut 26A.

The putter head 10A preferably has a width W measured between its heel and toe ends 16A, 18A as seen in FIG. 5 of at least 15 centimeters and a depth D that is at least equal to ½ width W. In the preferred embodiment of the putter head 10A, the width W is 17 centimeters and the maximum depth D is 10 centimeters. This results in the putter head 10A having a high moment of inertia with extreme perimeter weighting.

What is claimed is:

1. A golf putter comprising:

a putter head having a face member, a heel end and a toe end, said face member including a front surface arranged for impacting a golf ball;

said putter head including a rear member extending in an arcuate path from one end to the other end of said face member;

said putter head including first and second struts extending between and connected to said rear member and said face member, said first and second struts converging toward each other as they approach said face member;

said first and second struts being arranged to define open spaces between said face member and said rear member, said open spaces not being closed off by a bottom member thereby providing the putter head with increaded width and depth dimensions;

said putter head having a width W of at least 15 centimeters measured between said heel and toe ends; and said putter head having a depth D that is at least equal to ½ width W measured between the front surface of said face member and an outer surface of said rear member.

2. The golf putter of claim 1, wherein said putter head further comprises a third strut extending between and connected to said rear member and said face member, said third strut lying between said first and second struts.

3. The golf putter of claim 2, wherein said first, second and third struts are arranged to define four substantially trapezoid shaped open spaces between said face member and said rear member.

4. The golf putter of claim 1, wherein said arcuate path extends substantially 180 degrees.

5. The golf putter of claim 1, wherein said face member, said rear member and said struts are made of aluminum.

6. The golf putter of claim 1, wherein said face member, said rear member and said struts are made of titanium.

7. The golf putter of claim 1, wherein said putter head has a maximum width W of 17 centimeters.

8. The golf putter of claim 7, wherein said putter head has a maximum depth D of 10 centimeters.

9. The golf putter of claim 1, wherein said putter head has a desired weight of approximately 330 to 500 grams.

10. The golf putter of claim 1, wherein said face member has a height dimension, and wherein said first and second struts each have a height dimension that is substantially less than the height dimension of said face member.

11. The golf putter of claim 10, wherein said rear member has a height dimension that is substantially equal to the height dimension of said face member.

12. A golf putter comprising;

a putter head having a face member, a heel end and a toe end, said face member including a front surface arranged for impacting a golf ball;

said putter head including a rear member extending in an accurate path from one end to the other end of said face member;

said putter head including first and second struts extending between and connected to said rear member and said face member, said first and second struts converging toward each other as they approach said face member;

said putter head having a maximum width W of at least 15 centimeters measured between said heel and toe ends;

said putter head having a maximum depth D that is at least equal to ½ width W measured between the front surface of said face member and an outer surface of said rear member;

said putter head further including a third strut extending between and connected to said rear member and said face member, said third strut lying between said first and second struts;

said first, second and third strut being arranged to define four substantially trapezoid shaped open spaces between said face member and said rear member; and said first strut having and edge portion arranged generally parallel to one edge of said third strut, and said second strut having an edge portion arranged generally parallel to the opposite edge of said third strut.

* * * * *